US007080490B2

(12) United States Patent
Horn et al.

(10) Patent No.: US 7,080,490 B2
(45) **Date of Patent: *Jul. 25, 2006**

(54) EXTERIOR WINDOW SHUTTERS

(76) Inventors: Jack Horn, 1406 Harbert, Memphis, TN (US) 38104; James Horn, 8916 Forest Breeze, Cordova, TN (US) 38018

( * ) Notice: Subject to any disclaimer, the term of this patent is extended or adjusted under 35 U.S.C. 154(b) by 0 days.

This patent is subject to a terminal disclaimer.

(21) Appl. No.: 10/218,306

(22) Filed: Aug. 14, 2002

(65) Prior Publication Data

US 2002/0194804 A1 Dec. 26, 2002

Related U.S. Application Data

(63) Continuation of application No. 09/710,178, filed on Nov. 10, 2000, now Pat. No. 6,470,639.

(60) Provisional application No. 60/177,471, filed on Jan. 21, 2000.

(51) Int. Cl.
*E06B 3/30* (2006.01)
*E04C 2/22* (2006.01)

(52) U.S. Cl. ..... 52/309.7; 52/202; 52/455; 52/784.1; 52/797.1; 52/745.15; 49/501; 29/897.32

(58) Field of Classification Search ..... 52/309.16, 52/202, 455, 630, 797.1, 801.1, 801.11, 801.12, 52/473, 783.1, 783.12, 784.1, 790.1, 586.1, 52/586.2, 309.7; 49/501; 29/897.32
See application file for complete search history.

(56) References Cited

U.S. PATENT DOCUMENTS

| | | | | |
|---|---|---|---|---|
| 1,866,146 | A | 7/1932 | Yurkovitch | |
| 2,771,643 | A | 11/1956 | Zelov | 20/40 |
| 2,836,529 | A | 5/1958 | Morris | 154/53 |
| 2,940,137 | A | 6/1960 | Blake | |
| 3,131,514 | A * | 5/1964 | Siek | 52/315 |
| 3,401,494 | A * | 9/1968 | Anderson | 52/309.2 |
| 3,402,520 | A * | 9/1968 | Lee et al. | 52/309.6 |
| 3,546,841 | A * | 12/1970 | Randall et al. | 428/71 |
| 3,778,949 | A * | 12/1973 | Hellerich | 52/309.7 |
| 3,797,186 | A | 3/1974 | Smith | 52/314 |
| 3,810,338 | A | 5/1974 | Wolfert | 52/475 |
| 3,815,657 | A * | 6/1974 | Malek et al. | 160/229.1 |
| 3,886,703 | A | 6/1975 | Rousey | 52/473 |
| 4,020,609 | A | 5/1977 | Daniels | 52/473 |
| 4,049,038 | A | 9/1977 | Hyman et al. | 160/166 A |
| 4,069,632 | A | 1/1978 | Bode et al. | 52/309.7 |
| 4,079,560 | A * | 3/1978 | Weismann | 52/309.7 |
| 4,248,022 | A | 2/1981 | Walker | 52/473 |
| 4,374,693 | A * | 2/1983 | Pitt | 156/267 |
| 4,454,691 | A | 6/1984 | Mitchell | 52/202 |
| 4,480,416 | A * | 11/1984 | Judkins et al. | 52/376 |

(Continued)

FOREIGN PATENT DOCUMENTS

DE 31 29 231 A1 * 9/1982

(Continued)

*Primary Examiner*—Robert Canfield
(74) *Attorney, Agent, or Firm*—Butler, Snow, O'Mara, Stevens & Cannada PLLC

(57) ABSTRACT

The present invention relates to solid panel window shutters having both high strength and structural stability. More particularly, an exterior window shutter made of a solid panel of polyvinyl chloride with at least one support member affixed in the panel. The shutter includes a solid panel having front and back surfaces and side edges, support member, impact resistant member and slats having a channel to receive the support member; wherein the support member is embedded between the panel and the slats. Also contemplated by this invention are: a method to manufacture high strength and structurally stable exterior window shutters and a method to protect windows from extreme weather.

9 Claims, 17 Drawing Sheets

U.S. PATENT DOCUMENTS

| | | | | |
|---|---|---|---|---|
| 4,495,978 | A | 1/1985 | Carroll | 160/117 |
| 4,641,469 | A | 2/1987 | Wood | 52/309.12 |
| 4,747,245 | A * | 5/1988 | Lesmeister et al. | 52/309.7 |
| 4,830,898 | A | 5/1989 | Smith | 428/122 |
| 4,858,400 | A | 8/1989 | Foyt | 52/98 |
| 4,929,497 | A * | 5/1990 | Mitchell et al. | 442/139 |
| 5,125,116 | A | 6/1992 | Gaither et al. | 52/473 |
| 5,225,486 | A | 7/1993 | Money et al. | 52/473 |
| 5,237,785 | A | 8/1993 | Lukes | 52/86 |
| 5,351,459 | A | 10/1994 | Kassl et al. | 52/656.5 |
| 5,410,849 | A * | 5/1995 | Christopher | 52/309.2 |
| 5,487,243 | A | 1/1996 | Hale et al. | 52/202 |
| 5,526,627 | A * | 6/1996 | Beck | 52/519 |
| 5,617,683 | A | 4/1997 | Ney | 52/202 |
| 5,620,037 | A | 4/1997 | Apostolo | 160/118 |
| 5,655,351 | A * | 8/1997 | Pohl et al. | 52/784.15 |
| 5,778,958 | A | 7/1998 | Stebner | 160/210 |
| 5,799,462 | A | 9/1998 | McKinney | 52/742.13 |
| 5,848,505 | A | 12/1998 | Taylor | 52/202 |
| 5,893,248 | A | 4/1999 | Beliveau | 52/309.7 |
| 5,907,929 | A | 6/1999 | Poma et al. | 52/78 |
| 5,991,047 | A | 11/1999 | Kohlert et al. | 356/429 |
| 6,167,669 | B1 * | 1/2001 | Lanc | 52/426 |
| 6,401,419 | B1 * | 6/2002 | Beliveau | 52/592.6 |
| 6,536,172 | B1 * | 3/2003 | Amend | 52/426 |
| 2002/0124508 | A1 * | 9/2002 | Dunn et al. | 52/426 |

FOREIGN PATENT DOCUMENTS

| | | | |
|---|---|---|---|
| EP | 0 065 072 | A2 * | 11/1982 |
| EP | 0 164 332 | A2 * | 12/1985 |
| FR | 2 499 120 | A1 * | 8/1982 |

* cited by examiner

EXTERIOR WINDOW SHUTTERS

CROSS-REFERENCE TO RELATED APPLICATIONS

This is a continuation of U.S. patent application Ser. No. 09/710,178 filed Nov. 10, 2000 and entitled "Exterior Window Shutters". U.S. patent application Ser. No. 09/710,178 is hereby expressly incorporated by reference herein in its entirety, now U.S. Pat. No. 6,470,639.

This application claims priority under U.S.C. sec. 119, based on U.S. Provisional Application Ser. No. 60/177,471, filed Jan. 21, 2000. The entire disclosure of which is hereby incorporated by reference.

STATEMENT REGARDING FEDERALLY SPONSORED RESEARCH AND DEVELOPMENT

Not applicable.

REFERENCE TO A "MICROFICHE APPENDIX"

Not applicable.

BACKGROUND OF THE INVENTION

1. Field of the Invention

The present invention relates to a window shutter having both high strength and structural stability made of a solid front panel of polyvinyl chloride having at least one support member affixed in the panel.

2. Description of the Related Art

Window shutters have been used for many years, either for decorative purposes, protection during storms, or both. Early shutters were typically made of wood and were subject to several problems including rotting, warpage and dimensional changes due to moisture absorption. More recently, polyvinyl chloride has been used to manufacture shutters. Although the use of polyvinyl chloride has solved many problems associated with wooden shutters, existing polyvinyl chloride shutters may still be subject to strength and structural stability problems. U.S. Pat. No. 5,845,505 issued to Taylor discloses a window shutter having a panel made from various components. The Taylor shutter includes two vertical side members 11, with each having a channel, which accepts an aluminum rod 14. The side members 11 are then attached to the center portion of the shutter via mortise and tenon joints. An adhesive is used to seal the mortise and tenon joints. Window shutters having a face panel made of multiple pieces have limited structural stability and do not pass the standard industry testing for sever weather stability. Consequently, a need exists in this industry to produce a polyvinyl chloride outdoor window shutter of sufficient strength and structural stability to pass standard industry testing of severe weather stability.

BRIEF SUMMARY OF THE INVENTION

The present invention provides a window shutter that has both high strength and structural stability. The window shutter of the present invention is made of a solid front panel of polyvinyl chloride having at least one support member affixed in the panel to provide an increase in strength and stability. The support members can be arranged in various configurations including, but not limited to: at least one substantially lateral support member and at least one substantially longitudinal support member; at least two substantially longitudinal support members; at least two substantially diagonal support members; and at least one substantially longitudinal, at least one substantially lateral and at least one substantially diagonal support members. The support member can be covered by a polyvinyl chloride slat to conceal the support member. More particularly, an object of this invention is to provide a window shutter of generally rectangular shape having front and back surfaces and side edges and being made of a solid panel of polyvinyl chloride. The front surface of the panel is configured to define window shutter ornamentation such as raised panels or grooves.

Another object of this invention is to provide a window shutter comprising a solid panel of polyvinyl chloride; the panel having front and back surfaces and side edges, the solid panel having a channel to accept at least one support member, wherein the front side of the panel is configured to define window shutter ornamentation; at least one support member affixed in the channel and at least one slat configured to cover the support member, the slat is affixed to the surface of the panel.

Another object of this invention is to provide a window shutter comprising: a solid panel of polyvinyl chloride; the panel having front and back surfaces and side edges; the solid panel having a channel to accept at least one support member, wherein the front side of the panel is configured to define window shutter ornamentation and at least one support member affixed in the channel, wherein the support member is configured to retain an impact resistant member and an impact resistant member retained by the support member.

Another object of this invention is to provide a window shutter comprising: a solid panel of polyvinyl chloride; the panel having front and back surfaces and side edges, the solid panel having a channel to receive at least one support member, wherein the front side of the panel is configured to define window shutter ornamentation; at least one support member affixed in the channel, wherein the support member is configured to retain an impact resistant member; an impact resistant member retained by the support member and at least one slat configured to cover the at least one support member and impact resistant member, the at least one slat affixed to the panel.

Another embodiment of this invention involves a window shutter comprising: a solid panel of polyvinyl chloride, the panel having front and back surfaces and side edges wherein the front side of the panel is configured to define window shutter ornamentation, the solid panel having a plurality of channels; the shutter further comprising at least one lateral and at least one longitudinal support member being disposed in each of the channels and slats having a channel to accept the support members, wherein the support members are embedded between the panel and the slats.

Another object of the invention is to provide a window shutter made of a solid panel of polyvinyl chloride having channels to receive at least two substantially longitudinal support members, support members affixed in the channels and slats having a channel to receive the support members; wherein the support members are embedded between the solid panel and the slats.

Still another object of the invention is to provide a window shutter made of a solid panel of polyvinyl chloride having channels to receive at least two substantially diagonal support members, support members affixed in the channels and slats having a channel to receive the support member; wherein the support members are embedded between the solid panel and the slats.

Still another object of the present invention is to provide a window shutter having two geometric sections comprising: a solid panel of polyvinyl chloride configured to form adjoining rectangular and arcuate sections, the arcuate section having three sides; the arcuate section formed by two sides being at right angles and the third side being curved, the panel having channels to accept at least two substantially longitudinal support members and at least two substantially lateral support members in the rectangular section and at least three channels to accept support members in the arcuate section; support members affixed in the channels in the rectangular section and affixed in the channels in the arcuate section and slats configured to cover the support members, the slats affixed to the back surface of the panel.

Still another object of this invention is to provide a window shutter comprising: solid panel of polyvinyl chloride, having front and back surfaces and side edges and at least one nonlinear support member affixed in the panel, wherein the front side of the panel is configured to define window shutter ornamentation.

Still another object of this invention is to provide a method to make high strength and structurally stable outdoor window shutters comprising the steps of: providing a solid panel of polyvinyl chloride; routing at least one channel in the panel to accept at least one support member, affixing at least one support member in to the channel, providing at least one slat configured to cover the at least one support member and affixing the slat to the panel.

Another object of this invention is to provide a method to make high strength and structurally stable outdoor window shutters comprising the steps of: providing a solid panel of polyvinyl chloride having front and back surfaces and side edges; routing the front surface to provide window shutter ornamentation; routing at least one channel in the back surface of the panel to accept a support member; providing at least one support member configured to be accepted in the channel; providing an impact resistant member adapted to be retained by the support member; affixing the impact resistant member to the back surface of the panel; affixing the support members in to the channels thereby retaining the impact resistant member under a portion of the support member; providing slats comprised of polyvinyl chloride having channels to accept the support member and embeddeding the support member between the channel in the panel and the slats and the impact resistant member.

Still another object of this invention is to provide a method to protect windows in a dwelling from extreme weather comprising: affixing a window shutter to the dwelling, the window shutter being comprised of a solid panel of polyvinyl chloride, the panel having front and back surfaces and side edges, the solid panel having a channel to accept at least one support member, wherein the front side of the panel is configured to define window shutter ornamentation; at least one support member affixed in the channel, wherein the support member is configured to retain an impact resistant member; an impact resistant member retained by the support member and at least one slat configured to cover the at least one support member and impact resistant member, the slat affixed to the panel and providing means to close the window shutters to protect the windows.

BRIEF DESCRIPTION OF SEVERAL VIEWS OF THE DRAWING

A more complete understanding of the invention and its advantages will be apparent from the following Description of the Preferred Embodiment(s) taken in conjunction with the accompanying drawings, wherein.

DESCRIPTION OF THE PREFERRED EMBODIMENTS

Figure 1:
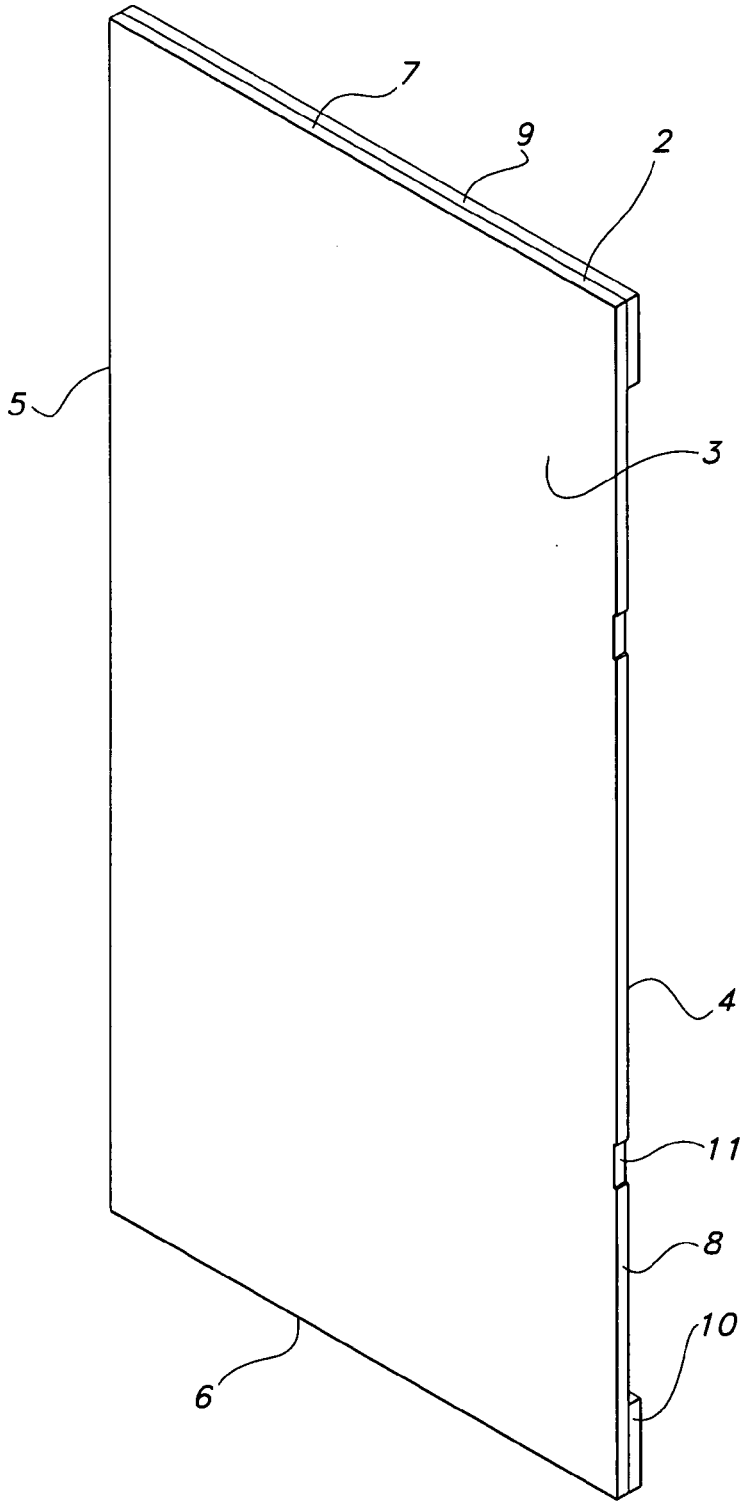
FIG. 1 shows an elevational view of a front panel.

Referring to FIG. 1, an embodiment is shown therein of an exterior window shutter panel 2. A sheet of polyvinyl chloride is machined on a Computer Numerically Controlled "CNC" router to form a generally rectangular panel having a front surface 3, back surface 4, side edges 5, 6, 7 and 8; although, any shape of shutter is contemplated by this invention. Any excess polyvinyl chloride, available when the panel is routed from the plastic sheet, is routed to form back support slats 9 and 10 for subsequent use in the assembly process. In the preferred embodiment the plastic sheet is polyvinyl chloride, but any thermoplastic resin of the appropriate properties can be used. These properties are excellent corrosion resistance and high strength to weight ratio. A single sheet of polyvinyl chloride that is from between 12 to 20 mm in thickness is generally used; however, two or more sheets of polyvinyl chloride can be bonded together to form a sheet having the desired thickness. The thickness of the sheet is selected depending on the particular application. For example, if elongated shutters are being produced thinner material is used to reduce the weight of the shutters. In the preferred embodiment the polyvinyl chloride sheet is 15 mm in thickness, preferably the sheet is 15 mm in thickness. A panel is routed from a sheet of polyvinyl chloride or bonded sheet of polyvinyl chloride to provide solid panel 2. The window shutters made in accordance with this invention, in one embodiment, can be notched on the outside edge 11 of the panel 2 to provide a means to affix hinges to secure the window shutter to a dwelling.

Figure 2:
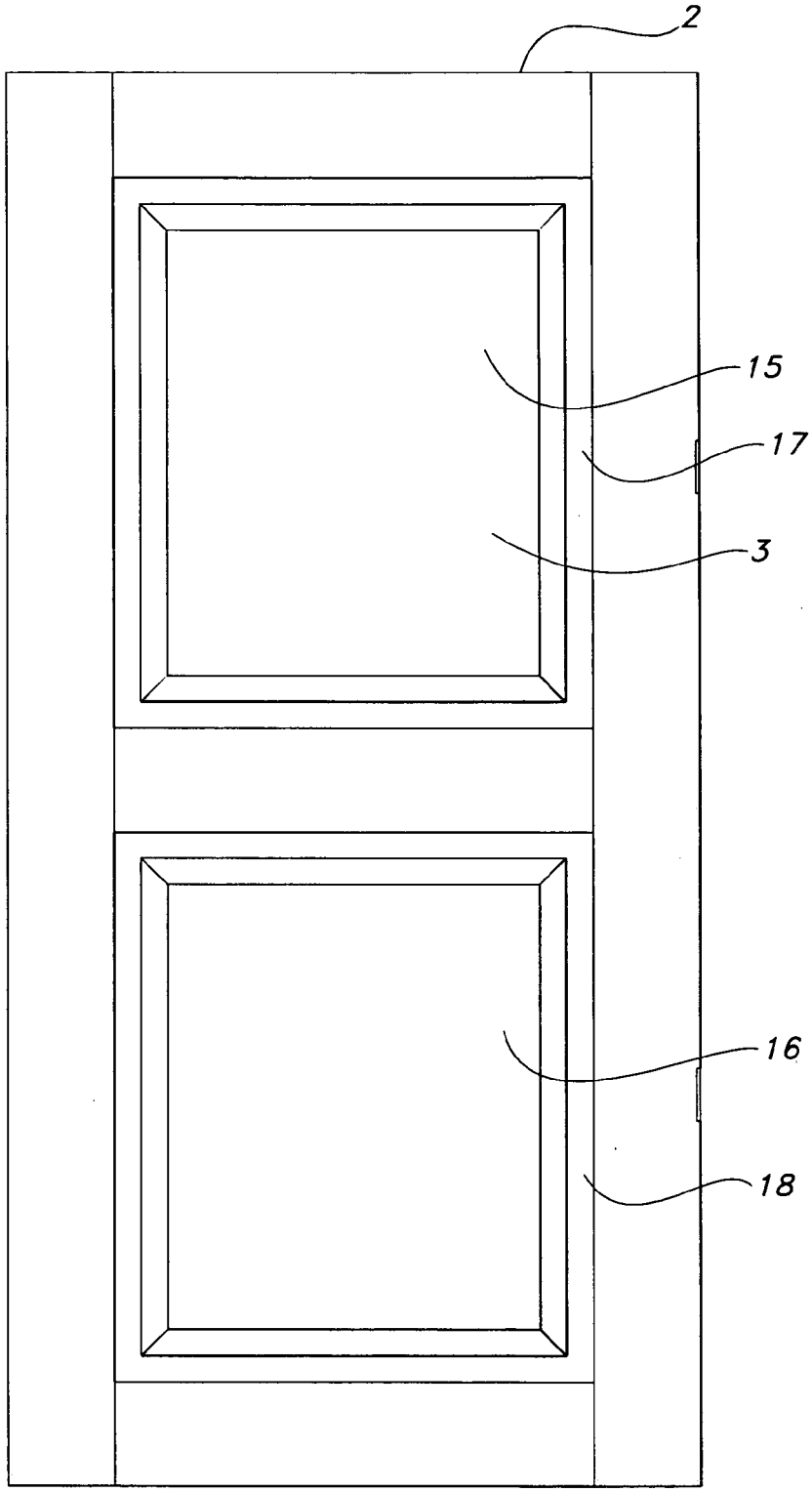
FIG. 2 shows an elevational view of the front surface of a panel.

Now referring again to FIG. 2 a 15 mm sheet of polyvinyl chloride is routed to form a solid panel 2 having raised panel ornamentation. The solid panel 2 can be configured to define panels 15 and 16 and ornamentation details such as borders 17 and 18. Panel ornamentation is made using bits to machine the front surface 3 to produce raised panels 15 and 16 and boarders 17 and 18.

Figure 3:
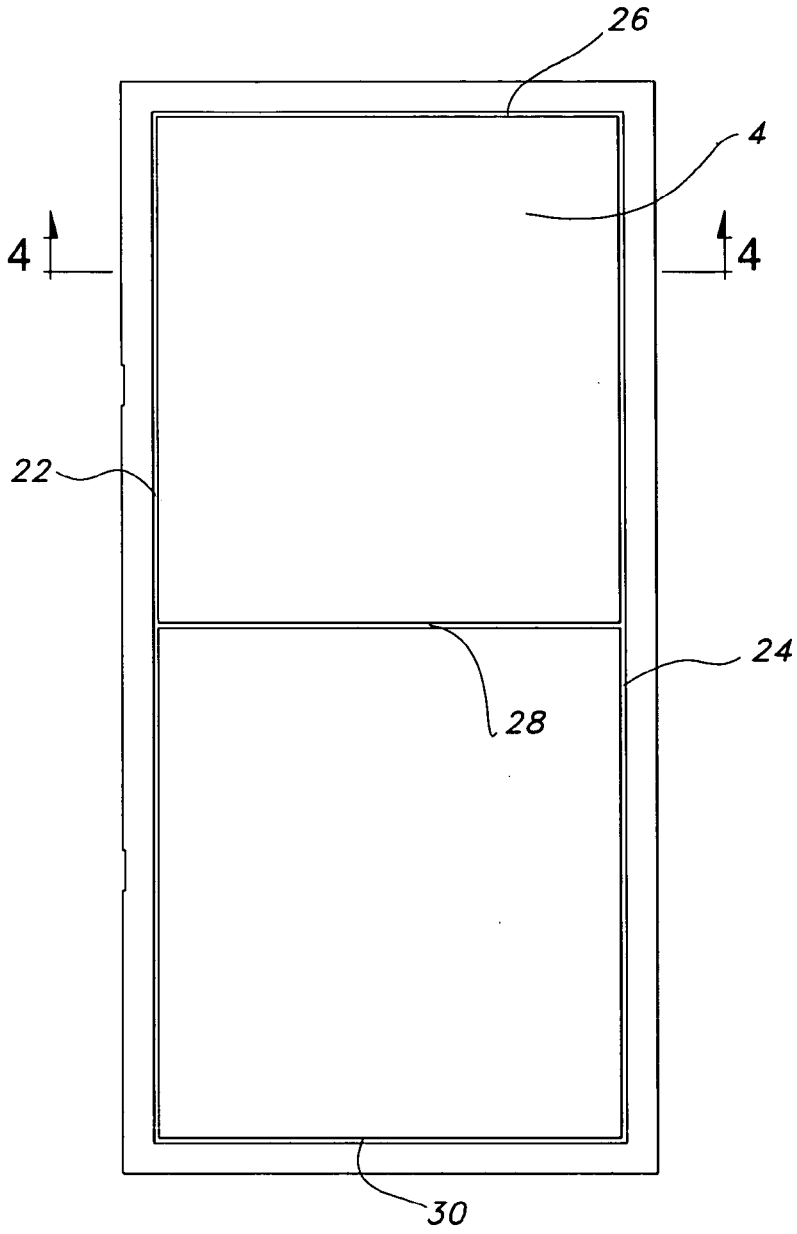
FIG. 3 shows an elevational view of a back surface of the panel.

Referring to FIG. 3 the back surface 4 of the panel 2 is shown. The back surface 4 is machined on a CNC router to form a series of channels 22, 24, 26, 28 and 30. These channels are formed to accommodate support members, which provide structural rigidity. In an alternate embodiment the shutters can be extruded or molded to contain a channel to receive the support member. The shape of the channel corresponds to the shape of the support member to be affixed in the channel. It should be noted that the channels can be contiguous or noncontiguous, but are shown this way in FIG. 3, by way of illustration.

The support member is rigid and is made of a lightweight metal such as aluminum. The support member can have various shapes, such as, for example, "L" shaped, "T" shaped, rectangular or circular depending on the application. The support members are arranged in the channel to provide support and stability for the decorative solid panel 2. The support member can be completely embedded in the solid panel 2 or can partially embedded in the solid panel 2 and reciprocal slats 0.9 and 10.

Figure 4:
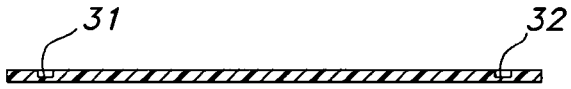
FIG. 4 shows a cross-sectional view of the back surface of the panel taken at line 4—4 from FIG. 3.

Now referring to FIGS. 3 and 4 a cross-sectional view of channels 22 and 24 is shown as 31 and 32 respectively. The sectional view is taken at 4—4. The channels 31 and 32 are ⅜ inches in depth and ¾ inch in width and are routed to accept an "L"-shaped extrusion of aluminum in this embodiment. In an alternative embodiment, channels 22, 24, 26, 28 and 30 can be routed or molded to accept a square extrusion. In other alternative embodiments, channels 22, 24, 26, 28 and 30 can be routed to accept a support member that is rectangular or a generally circular extrusion. Generally channels are from between ⅛ to ⅜ inches deep and are from ⅛ to ¾ inches in depth and ⅜ inches in width. The orientation of the channel relates to the desired position of the support member in the solid panel 2.

Figure 5:
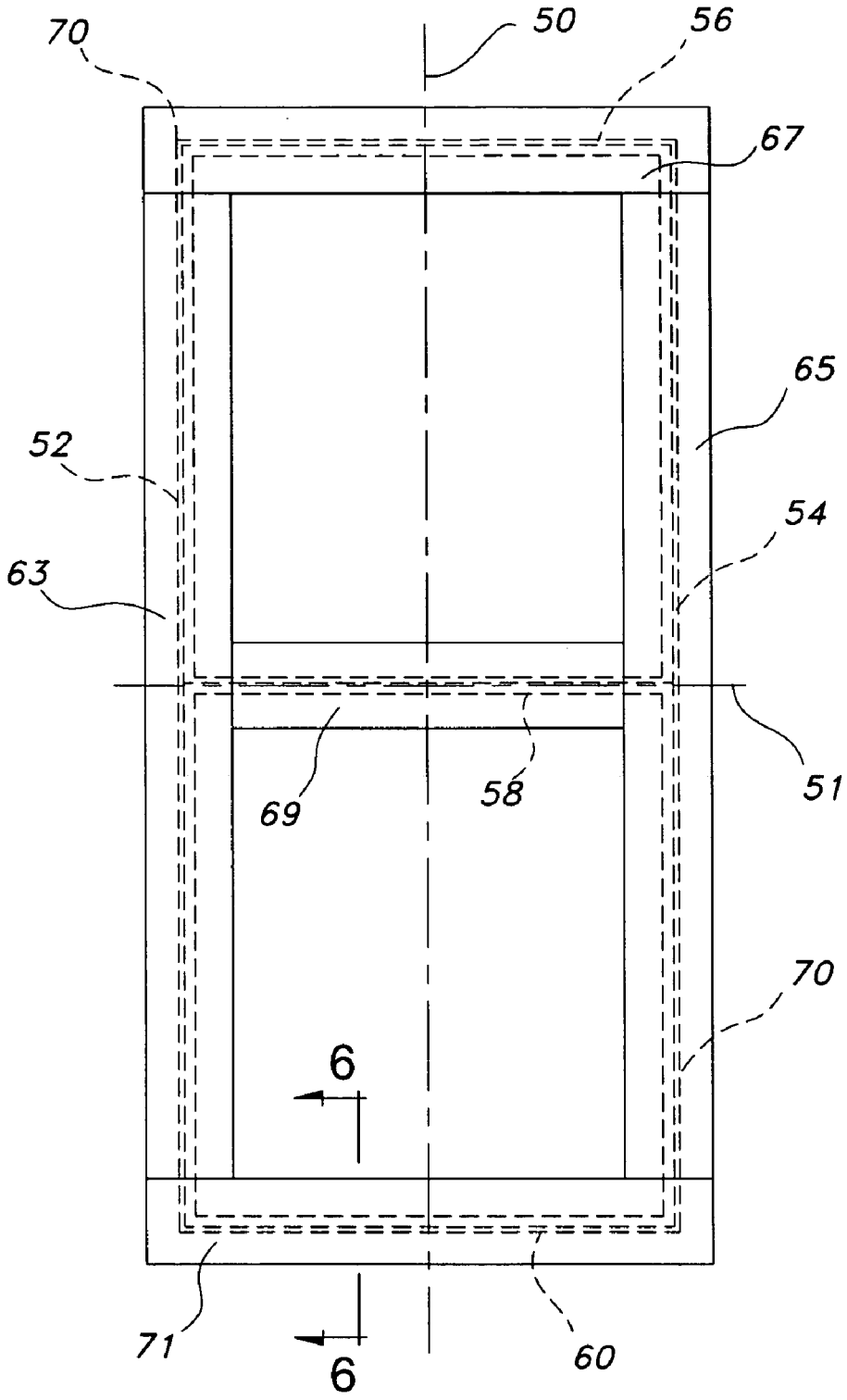
FIG. 5 shows an elevational view of the back surface of the panel with hidden detail lines to show the support members affixed into the channels.

Now referring to FIGS. 3 and 5, a longitudinal centerline 50 and a lateral centerline 51 are shown. The location of the support members will be discussed with respect to these axes. For instance, a member described as a lateral member is a laterally extending member and is substantially parallel to the lateral center axis. The support members 52 and 54 shown by hidden detail lines are affixed in channels 22 and 24 to provide substantially longitudinal support and support members 56, 58, and 60 are affixed in channels 26,28 and 30 to provide substantially lateral support. It should be noted that the support members do not have to be in contact with other support members. The support member can be selected from the following group of materials: metal, such as steel or titanium, wood, and plastic, but is preferably aluminum. The support member is affixed into the channel by the application of an appropriate adhesive such as Accrabond™ adhesive. The arrangement of support members in this embodiment is preferred and is referred to as the figure "8" configuration 70.

It is generally contemplated by this invention that support members may be affixed in the solid panel 2 at various angles to produce shutters having high strength and structural stability. In the preferred embodiment at least one supporting member is substantially lateral and at least one support member is substantially longitudinal, forming a figure "8" configuration 70. In this configuration the lateral members provide resistance to warpage and the longitudinal members provide strength capacity for hinging to a dwelling. If the support members are in contact or are formed as a one-piece frame, for the purposes of this invention, they are considered according to their orientation, to be longitudinal, lateral or diagonal; that is, according to this definition, a one-piece support frame having a figure "8" configuration 70 would be considered to have two longitudinal support members and three lateral support members. Additionally, it is further contemplated that a support member may be affixed substantially diagonally to the centerline. It is further contemplated in certain applications that only substantially longitudinal support members are required; that is, if the shutters are nonfunctional, i.e. cannot be pivoted to cover the window and are permanently affixed to a dwelling, and then only two substantially longitudinal support members are required. Additionally, in an alternative embodiment a non-linear channel is routed near the edge of panel. This channel can follow the entire, or a lesser portion of the periphery, in a nonlinear manner. It is possible that only one channel need be formed if the channel follows the periphery of the shutter.

Figure 6:
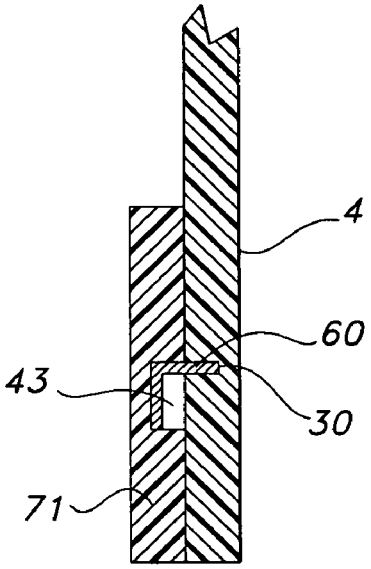
FIG. 6 shows a sectional view of "L"-shaped support member, taken at line 6—6 from FIG. 5.

Referring to FIGS. 5 and 6, the slats 63, 65, 67, 69, and 71, produced as a byproduct of the above operation are applied to the back surface 4 of the panel. The slats are generally from between 2 to 4 inches width, but are preferably about three inches in width and run the length or width of the channel routed in solid panel 2. The slats are configured to cover the support members. It should be noted that the slats could be made of other suitable material such as aluminum or wood. The face of the slat contacting the support member may have a solid surface or may be routed to accept the support member. Slats 63, 65, 67, 69 and 71 are routed to accept support members 52, 54, 56, 58 and 60. The routed section of the 63, 65, 67, 69 and 71 is preferably ⅜ inches in depth and ¾ inches in width to accept the "L"-shaped aluminum extrusion.

Now referring to FIG. 6, a cross section of FIG. 5 is taken at line 6—6. In this view back surface 4, slat 71, "L"-shaped support member 60 are shown. The channel 30 in the back surface 4 is about ⅜ inches in depth and about ⅛ inch in width and is routed to accommodate an "L"-shaped support member 60. The channel 43 in slat 71 is about ⅜ inches in width and about ¾ inches in depth.

Now specifically, with respect to the slats shown in FIG. 5, slats 63, 65, 67, 69 and 71 are affixed over the support members 52, 54, 56, 58 and 60. Bonding agents, such as 3M Scotch-Strip™ 4475, are applied to the back surface of the solid panel when the slats are subsequently attached. The slats can also be additionally affixed to the solid panel using small brads.

Figure 7:
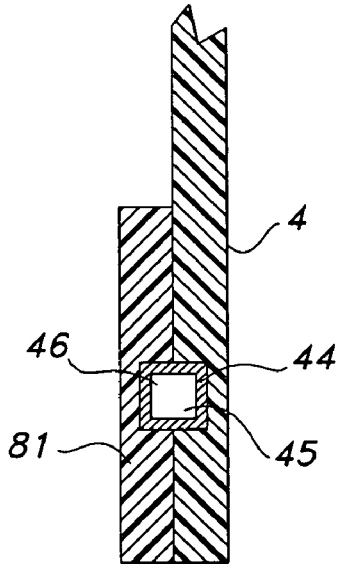
FIG. 7 shows a sectional view of the first alternative embodiment for the support member: a square shaped member.
Figure 9:
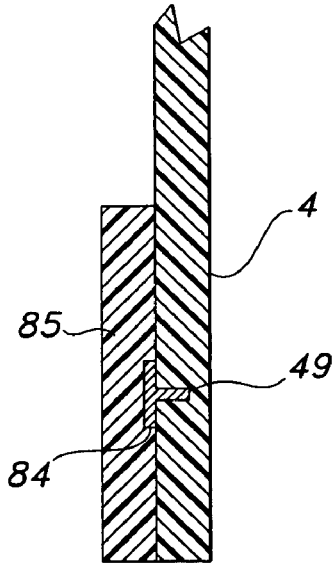
FIG. 9 shows a sectional view of a third alternative embodiment for the support member a "T" shaped member.
Figure 10:
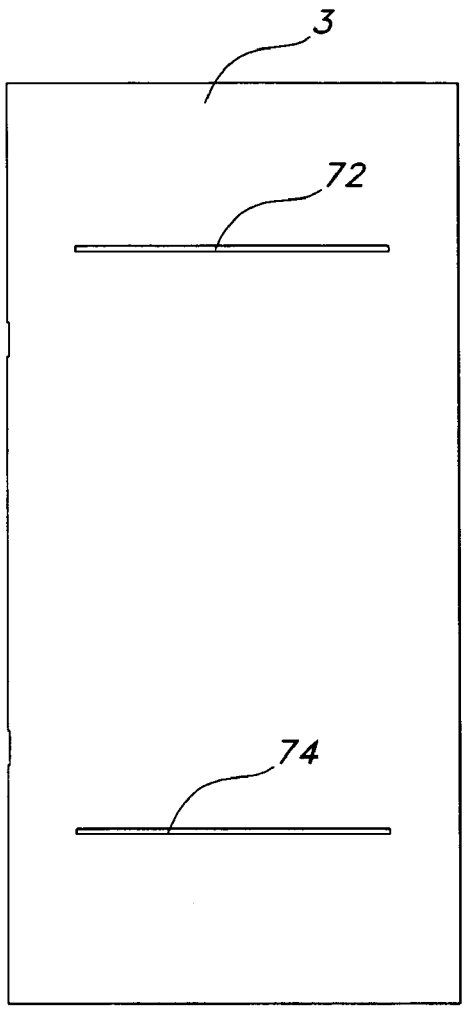
FIG. 10 shows the first alternative embodiment in an elevational view of the front surface of the beaded panel.
Figure 11:
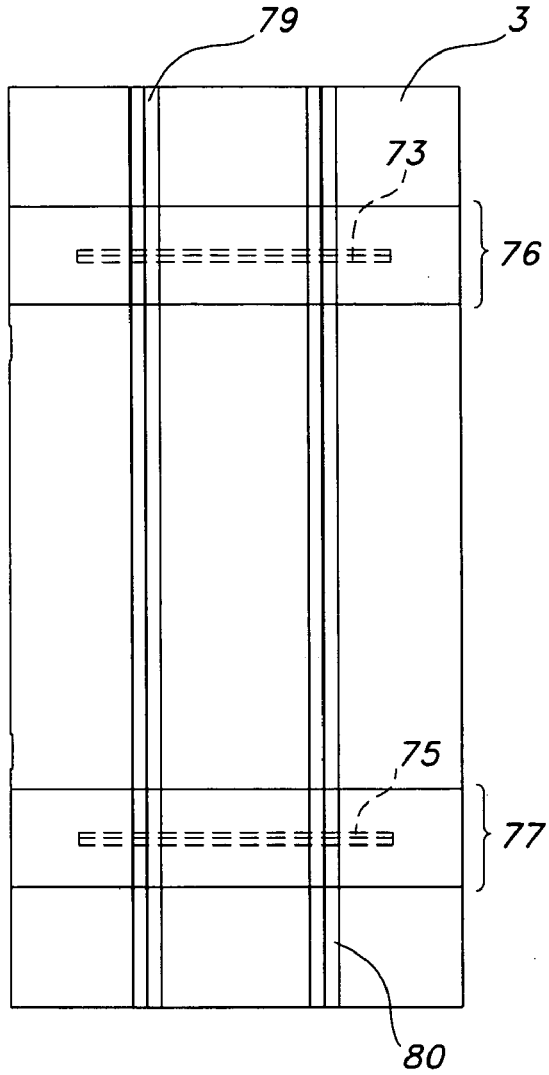
FIG. 11 shows a first alternative embodiment in an elevational view of the front surface of the panel with hidden detail lines to show the support members affixed into channels.
Figure 12:
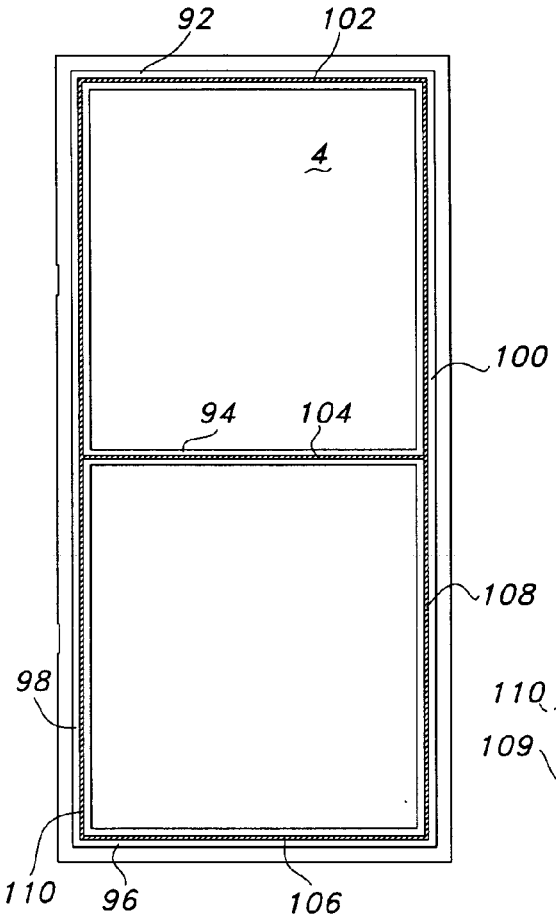
FIG. 12 shows a first alternative embodiment in an elevational view of the back surface of the beaded panel.

Now referring to FIGS. 7 and 9, alternative embodiments are shown. In FIG. 7 a square support member is shown. More particularly, in FIG. 7, back surface 4, slat 81 and square extrusion 44 is shown is channel 45 in back surface 4 and channel 46 in slat 81. In this embodiment the size of the channel ranges from ⅛ to ¾ inches.

Figure 8:
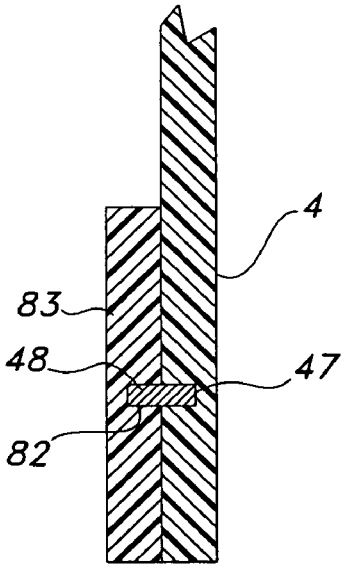
FIG. 8 shows a sectional view of a second alternative embodiment for the support member: a rectangular shaped member.

Now referring to FIG. 8, a back surface 4 is shown with channel 47 and slat 83 with channel 82. These channels are sized to accept a rectangular extrusion 48. In this embodiment the size of the channel ranges from ⅛ to ¾ inches.

Now referring to FIG. 9 a "T" shaped member is shown more particularly, a back surface 4 is shown with a channel 49 to accommodate the base of the "T" and slat 85 with channel 84 is routed to accept the top of the "T" shaped support member. Channel 49 is between ⅝ and ¾ of an inch in width and channel 84 is between 1 and 1¾ inch in width. The depth of each channel is ⅜ of an inch. In the preferred embodiment channel 49 is ⅝ inch in width and ⅜ inch in depth and channel 84 is 1¾ inch in width and ⅜ inch in depth.

The resulting process provides an extremely durable and weather resistant product capable of withstanding many years of exterior use without rotting, warping or splitting, defects common with shutters made from the conventional materials. The front surface 3 can be machined using different cutters to configure the front panel to simulate a window shutter having a particular style. The different styles are raised panel, beaded board, arched top, elongated and cutout style. The shutters can be notched along the outside edge to receive a means to attach the shutter to a dwelling. The attachment means may be a hinge or any suitable means. In an alternative embodiment, the hinge or slide bolt, can be attached to the support member to provide greater stability.

Now referring to FIG. 10-13, an alternative embodiment, the beaded board style shutter is shown. Substantially lateral channels 72 and 74 are routed into front surface 3. These channels are about ⅛ inch in width and about ⅜ inch in depth. Channels 72 and 74 accommodate an "L"-shaped support member as shown in FIG. 6. Now referring to FIG. 11 the "L"-shaped aluminum support members 73 and 75 are affixed in channels 72 and 74 to the front surface 3 with Accrabond™ adhesive. Slats 76 and 77 having a channel to accept the "L"-shaped support member are affixed to the front surface 3 with 3M Scotch-Stripe™ 4475. Slats 76 and 77 can also be attached with small brads. The front surface 3, with slats 76 and 77 attached, is routed with two grooves 79 and 80 to achieve a beaded panel appearance.

If additional support members are needed they can be added as follows. Now referring to FIGS. 12 and 13, the back surface 4 is shown. Three substantially lateral channels 92, 94 and 96 are routed to accept an "L"-shaped support member and two substantially longitudinal channels 98 and 100 are routed to accept "L"-shaped support members. These channels are about ⅛ inch in width and about ⅜ inch in depth. A plurality of "L"-shaped aluminum extrusion support members are affixed in channels 92, 94, 96 and 98 in the back surface 4 with Accrabond™ adhesive and are shown in this figure as 102, 104, 106, 108 and 110.

Figure 13:
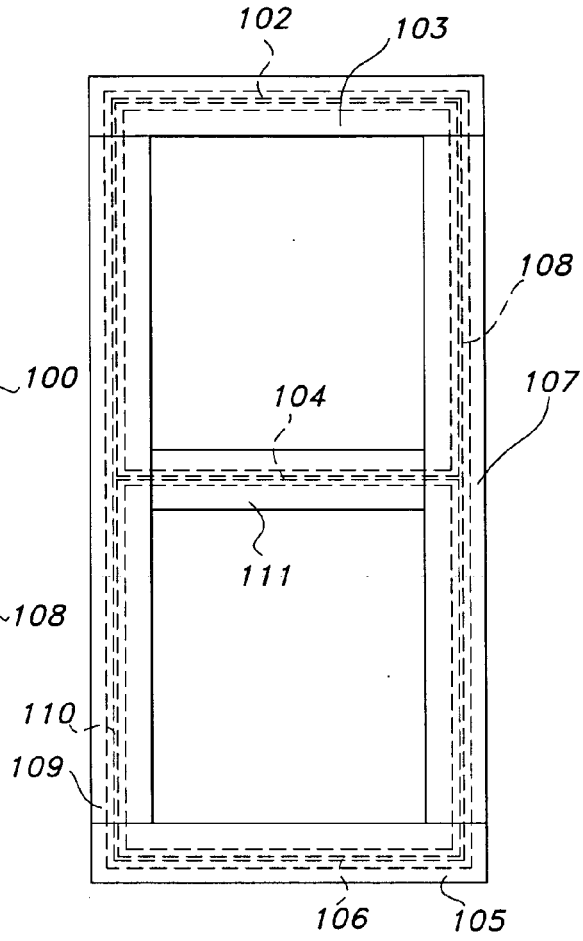
FIG. 13 shows a first alternative embodiment in an elevational view of the back surface of the panel with hidden detail lines to show the support members affixed into channels.

Now referring to FIG. 13, support members 102, 104, 106, 108 and 110 are shown in the channels by hidden detail lines. Slats 103, 105, 107, 109 and 111 having a channel to accept an "L"-shaped extrusion are affixed to the back surface 4 with 3M Scotch-Strip™ 4475. The slats 103, 105, 107, 109 and 111 can also be attached with small brads.

Figure 14:
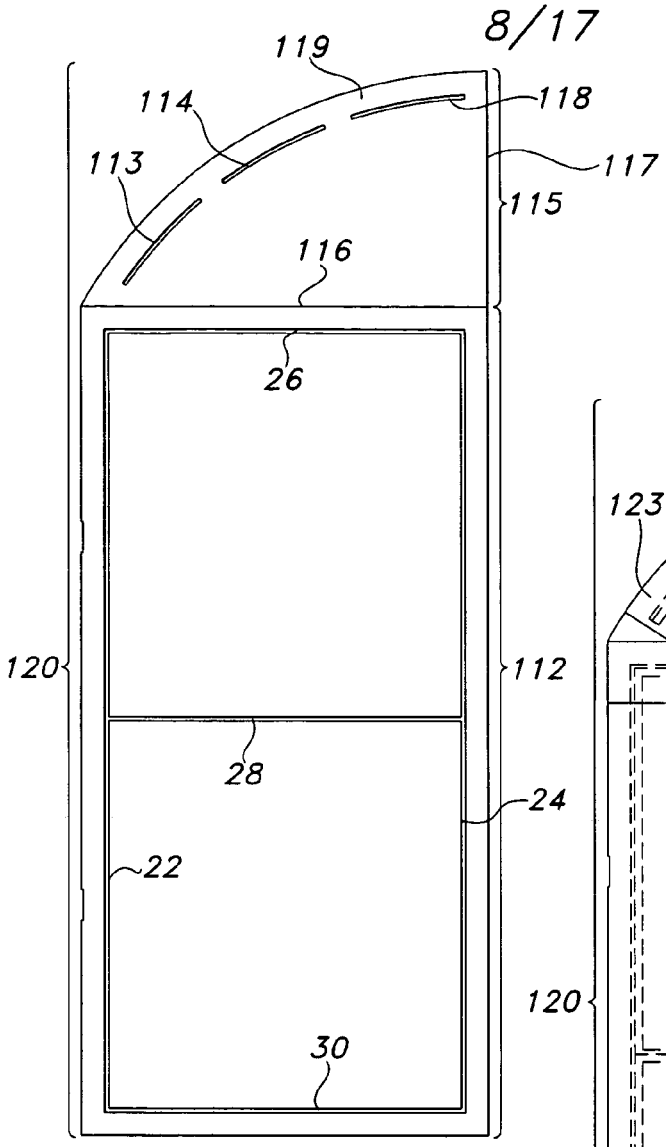
FIG. 14 shows a second alternative embodiment in an elevational view of the back surface of an arched panel.
Figure 15:
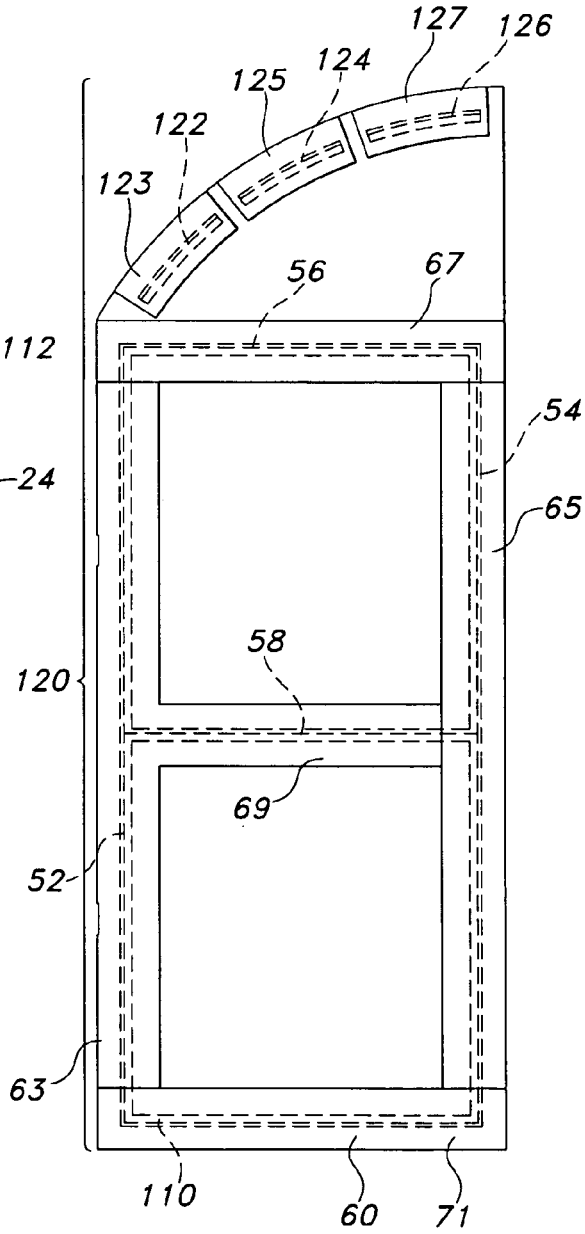
FIG. 15 shows a second alternative embodiment in an elevational view of the back surface of the arched panel with hidden detail lines to show the support members affixed into channels.

Referring to FIG. 14, an alternative embodiment, the arched shaped panel, is shown. A sheet of 15 mm polyvinyl chloride is milled to form an arched shaped panel 120. More particularly, a panel having two geometric sections is provided wherein a solid panel of polyvinyl chloride is configured to form adjoining rectangular 112 and arcuate 115 sections. The arcuate section 115 has three sides; wherein the section is formed by two sides 116 and 117 being at right angles and the third side 119 forming an arcuate edge. In FIG. 15 the backside of the arched panel 120 is shown. The preferred figure "8" pattern of support members is shown for the lower rectangular section of the panel 112. The formation of the panel with channels, selection of the support members, affixation of the support members in the channels, and affixation of the slats for the figure "8" configuration 70 is shown in FIGS. 5 and 6 and accompanying text. In this embodiment the support member is a unitary preformed aluminum frame 110. The arcuate section 115 of the panel is routed to provide at least three channels 113, 114 and 118. These channels are routed to accept an "L"-shaped support member and are about ⅛ inch in width and about ⅜ in depth. These channels accommodate an "L"-shaped extrusion of aluminum as shown in FIG. 6

In an alternative embodiment, the arched panel can be reinforced with a curved channel routed into the panel along all or a portion of the arched side of the shutter panel and two channels can be routed in the opposite bottom side of the panel at right angles. These channels can accommodate a curved extrusion and two linear or right angle support members or any similar configuration.

Now referring to FIG. 15 the "L"-shaped aluminum extrusion support members 122, 124, and 126 are affixed in channels 113, 114 and 118 in the back surface 120 with Accrabond™ adhesive. Slats 123, 125 and 127 each having a channel to accept the "L"-shaped support member are affixed to the back surface 120 with 3M Scotch-Strip™ 4475. The slats 123, 125 and 127 can also be attached with small brads. Alternatively, the slat can be formed from one curved piece containing a channel to receive the "L" shaped support members affixed in the back surface 120 of the solid panel.

Figure 16:
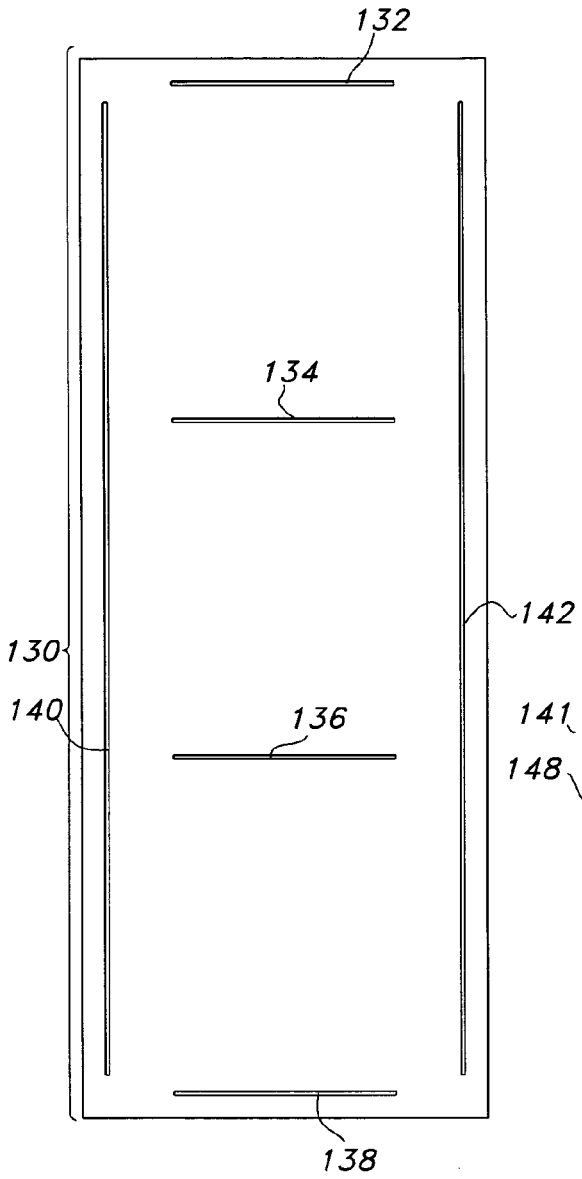
FIG. 16 shows a third alternative embodiment in an elevational view of the back surface of an elongated panel.

Referring to FIG. 16 a panel of polyvinyl chloride is milled to form an elongated shaped panel 130. In FIG. 16, the back surface 131 has four substantially lateral channels 132, 134, 136, and 138 routed to accept an "L"-shaped support member and two substantially longitudinal channels 140 and 142 routed to accept an "L"-shaped support member. These channels are about ⅛ inch in width and about ⅜ inch in depth. These channels accommodate an "L"-shaped extrusion of aluminum shown in FIG. 6.

Figure 17:
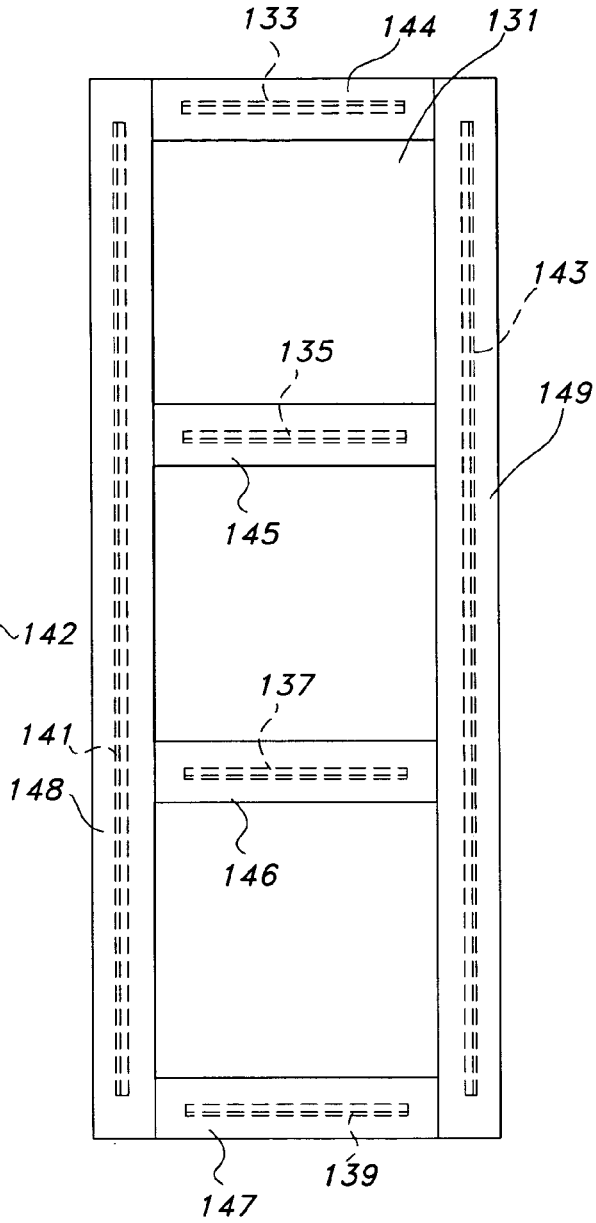
FIG. 17 shows a third alternative embodiment in an elevational view of the back surface of the elongated panel with hidden detail lines to show the support members affixed into channels.

Referring now to FIG. 17, the "L"-shaped aluminum extrusion support members 133, 135, 137, 139, 141 and 143 are affixed into channels 132, 134, 136, 138, 140 and 142 in the back surface 131 with Accrabond™ adhesive. Slats 144–149 each having a channel to receive the "L"-shaped support member, are affixed to the back surface 131 with 3M Scotch-Strip™ 4475. The slats 144–149 can also be attached with small brads.

Figure 18:
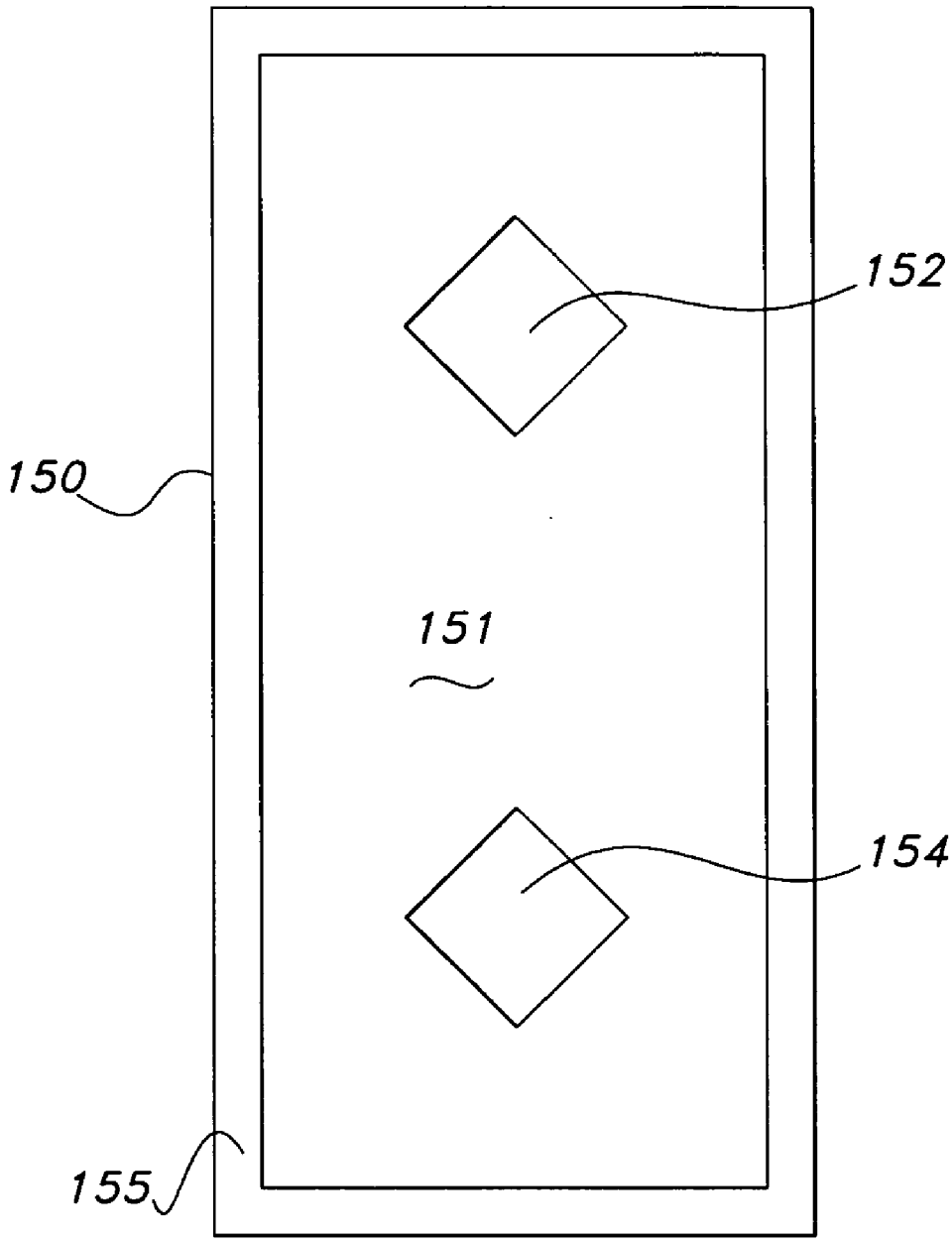
FIG. 18 shows a fourth alternative embodiment in an elevational view of the front surface of a cut out panel.

Referring now to FIG. 18, an alternative embodiment, the cutout style panel is shown. In this embodiment a sheet of polyvinyl chloride is routed to form a rectangular panel 150 with a cutouts 152 and 154, which extends through the panel. The cutouts can have any decorative shape, such as a star or moon for example. The front surface of the panel 151 can also have decorative trim 155.

Figure 19:
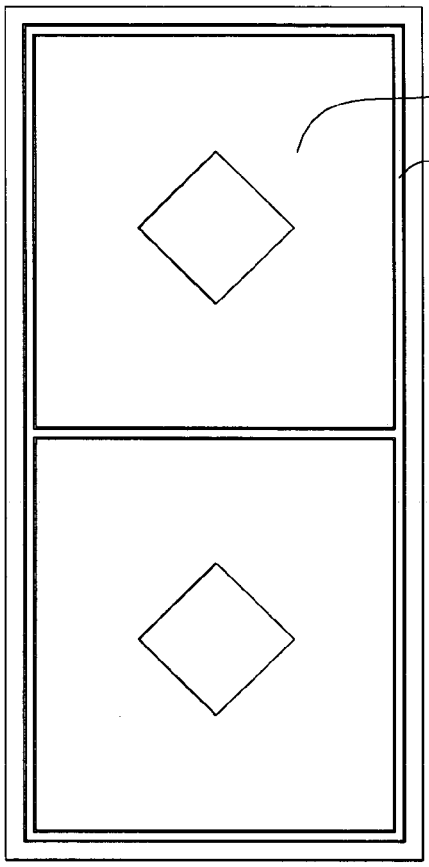
FIG. 19 shows a fourth alternative embodiment in an elevational view of the back surface of a cut out panel.
Figure 20:
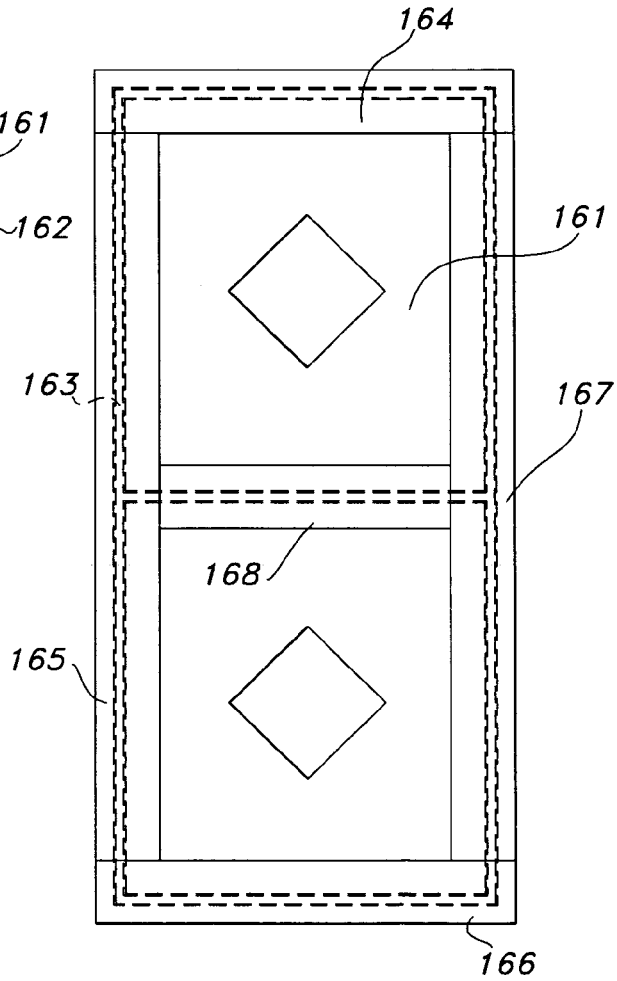
FIG. 20 shows a fourth alternative embodiment in an elevational view of the back surface of the cut-out panel with hidden detail lines to show the support members affixed into channels.

FIG. 19, the back surface 161 of the panel is shown. A channel 162 is routed to receive a support member. The support member selected in this application is a circular tube of aluminum ¼ inch in diameter. The unitary aluminum frame 163 of tubular aluminum is affixed in channel 162. Slats 164, 165, 166, 167 and 168 the length of width of the panel and three inches in width are routed to accept the frame 163. Slats 164–168 are affixed to the back surface 161 with 3M Scotch-Strip™ 4475 and can also be attached with small brads. Alternatively, the cutout can reinforced in a similar manner with support members and slats.

Figure 21:
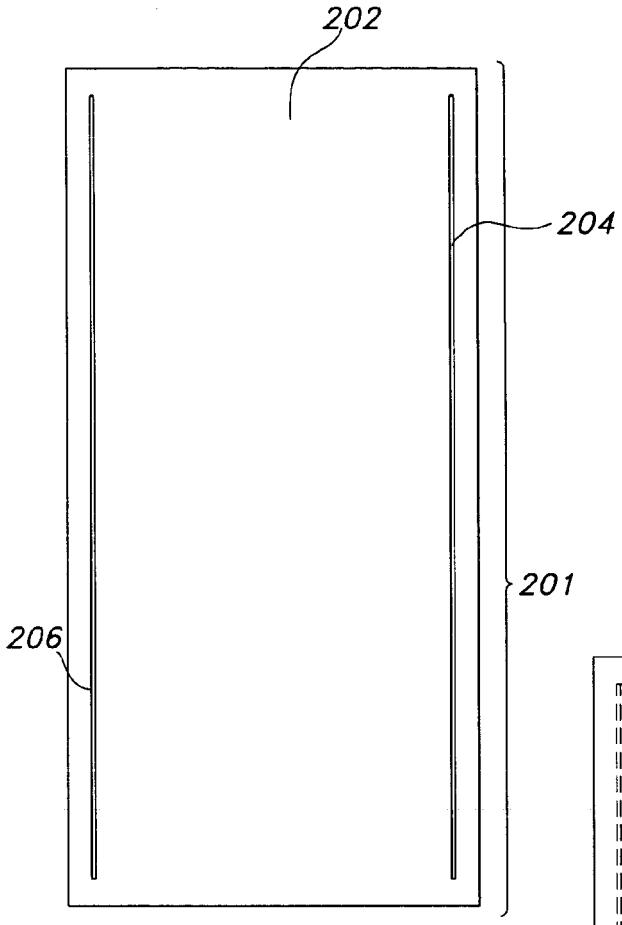
FIG. 21 shows a fifth alternative embodiment in an elevational view of the back surface of a decorative panel.

Referring now to FIG. 21, another alternative embodiment, a nonfunctional decorative shutter panel 201 is shown. The face of the shutter can be milled to provide decorative ornamentation as desired. In this embodiment a sheet of polyvinyl chloride 12, 14 or 16 inches in width is machined from a sheet of 19 mm polyvinyl chloride. The back surface 202 of panel 201 has two substantially longitudinal channels 204 and 206 routed to accept an "L"-shaped support member. These channels are about ⅛ inch in width and about ⅛ inch in depth. These channels accommodate an "L"-shaped extrusion of aluminum shown in FIG. 6.

Figure 22:
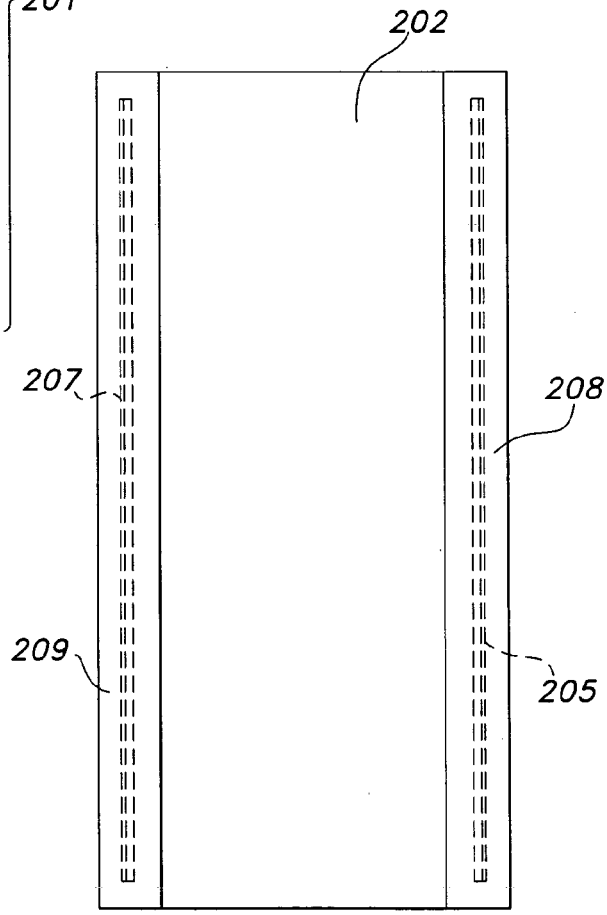
FIG. 22 shows a fifth alternative embodiment in an elevational view of the back surface of the decorative panel with hidden detail lines to show the support members affixed into channel.

Now referring to FIG. 22 the "L"-shaped aluminum extrusion support members 205 and 207 are affixed into channels 204 and 206 with Accrabond™ adhesive. Slats 208 and 209 each having a channel to receive the "L"-shaped support member are affixed to the back surface 202 with 3M Scotch-Strip™ 4475. The slats 208 and 209 can also be attached with small brads.

Figure 23:
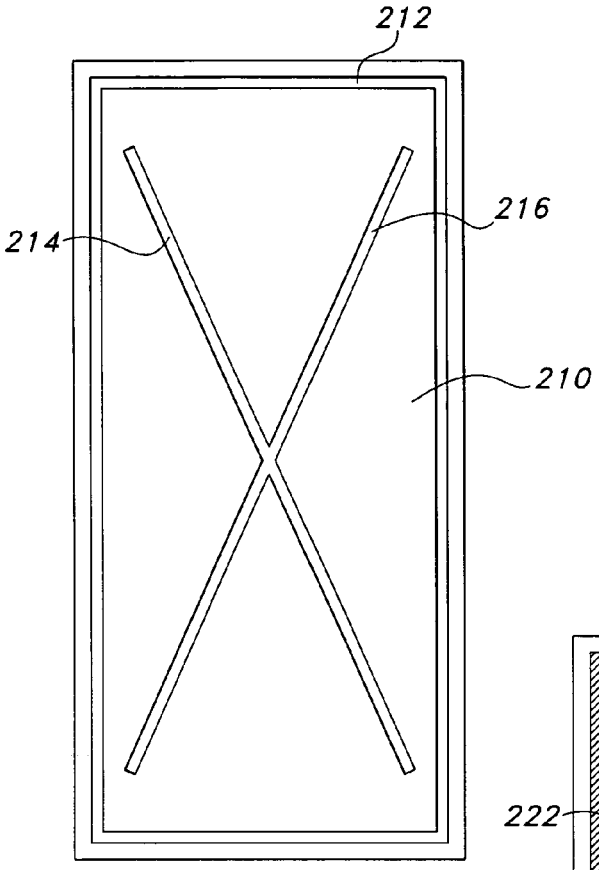
FIG. 23 shows a sixth alternative embodiment in an elevational view of the back surface of a panel with diagonal support members.

Referring to FIG. 23, another alternative embodiment of the shutter panel 2 is shown with diagonal support members. In this embodiment the back surface 210 of the panel is provided with diagonal support members. The back surface 210 is routed to form channels 212, 214 and 216, to accept a square shaped support member see FIG. 7. These channels are about ¾ inch in width and about ¾ inches in depth.

Figure 24:
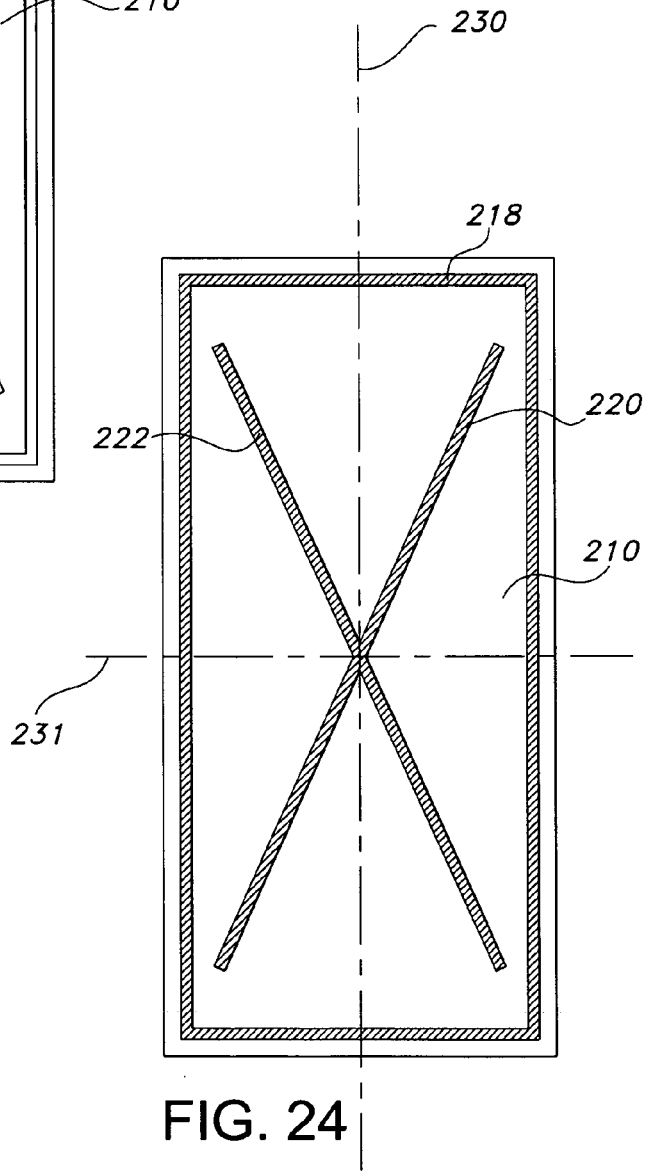
FIG. 24 shows a sixth alternative embodiment in an elevation view of the back surface a panel with diagonal support member.
Figure 25:
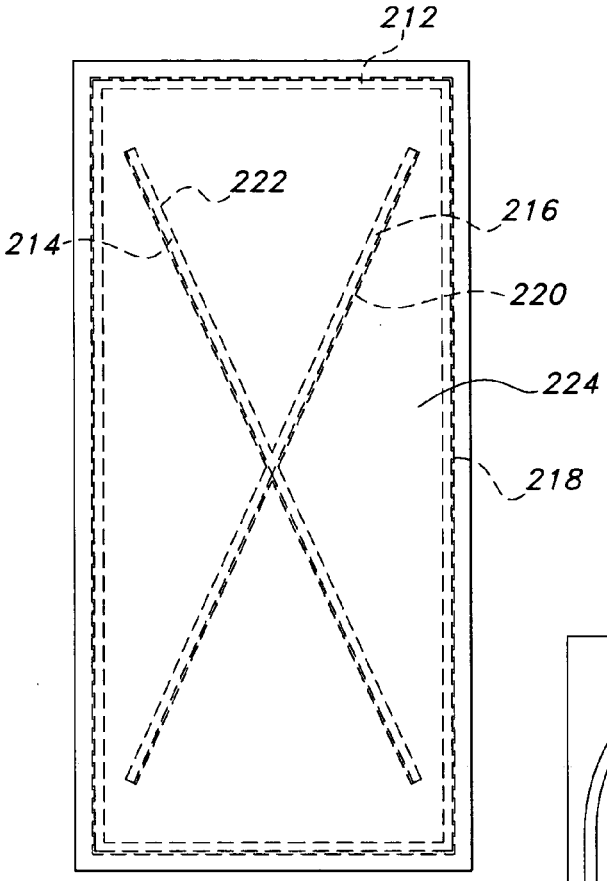
FIG. 25 shows a sixth alternative embodiment in an elevational view of the back surface of the panel with diagonal support members shown with hidden detail lines to show the support members affixed into channels.

Now referring to FIG. 24, an additional view of the back surface 210 is shown with the longitudinal centerline 230 and lateral centerline 231. The location of the support members will be discussed with respect to these axes. For instance, a member described as a diagonal member is a diagonally extending member and is substantially diagonal to the lateral or longitudinal center axis. The support members 218, 220, 222 are affixed in channels 212, 214 and 216. Support members 220 and 222 are substantially diagonal to the centerlines 230 and 231. It should be noted that although the support members are in contact in this illustration, it is contemplated by this invention that they may not be in contact. The "square" aluminum extrusion support members 218, 220 and 222 are affixed in the channels with Accrabond™ adhesive. A slat 224 having a channel to accept the "square" extrusion 218, 220 and 222 is affixed with 3M Scotch-Strip™ 4475 to the back face of the shutter 210. Slat 224 can also be attached with small brads. The slat 224 has substantially the same dimensions as the solid panel 210.

Figure 26:
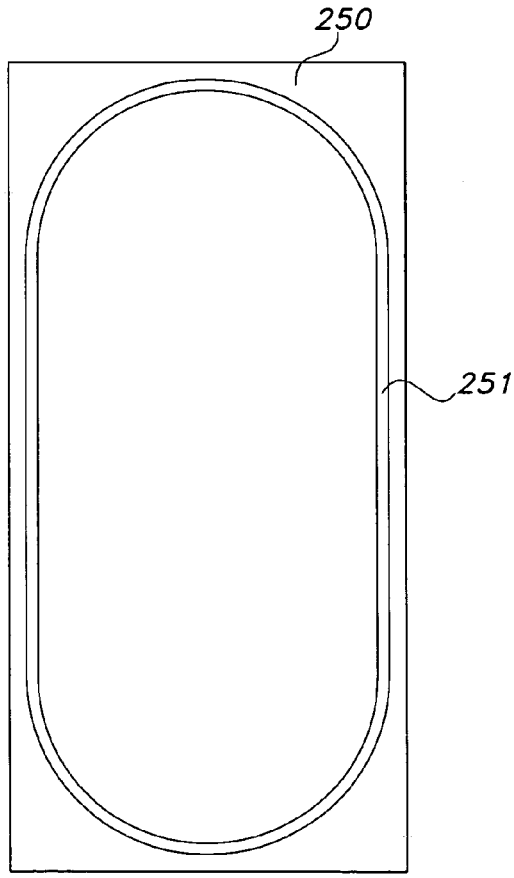
FIG. 26 shows an elevational view of the back surface of a panel with a nonlinear channel.

Now referring to FIG. 26, another alternative embodiment is shown wherein the back surface 250 of a shutter panel 2 is shown with a nonlinear channel 251. In the embodiment shown in FIG. 26, the channel follows substantially the periphery of the back surface 250 of panel 2. A one-piece nonlinear support member could be shaped to fit into this channel 251. Additionally, in another alternative embodiment a nonlinear support member could be used to support the arch portion 119 of the panel 120. The support member can be completely embedded in the back surfaces the panel and not require reciprocating slats.

To further increase the stability of these windows shutters an impact resistant member can be applied substantially to the back surface 4. The impact resistant member can be a polycarbonate, such as Lexan™ or it can be structural honeycomb of plastic or aluminum such as Plascore™. The impact resistant member can be applied to the back surface 4 by any number of means. These means include: retained under a support member configured to retain the impact resistant member or retained by the slats which are configured to retain the impact resistant member. FIG. 27-30 discloses various embodiments of window shutters with impact resistant members.

Figure 27:
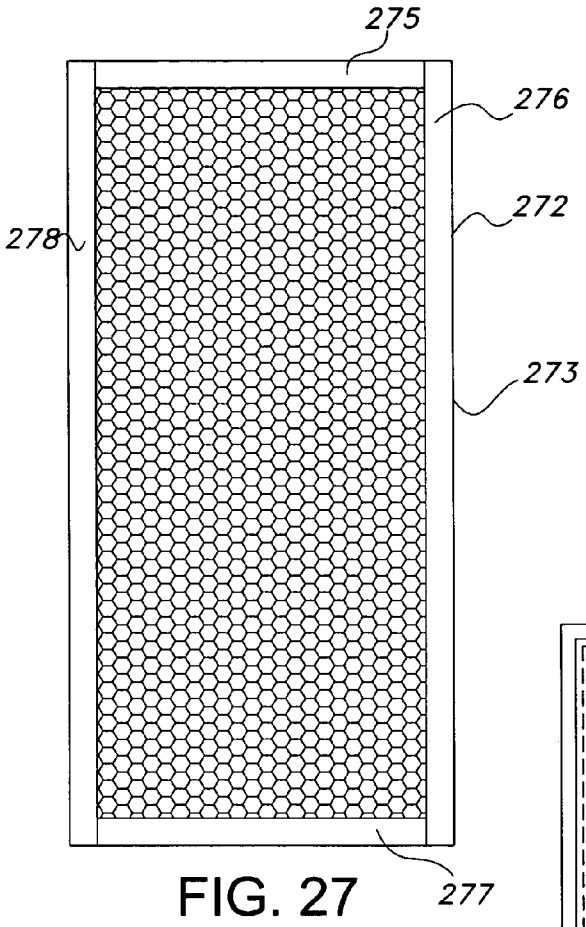
FIG. 27 shows an alternative embodiment in an elevational view of the back surface of the decorative panel with a structural honeycomb structure retained by the slats.

Now referring to FIG. 27 a sheet of polyvinyl chloride is milled to form a rectangular shaped panel 272 that is 15 mm inches in thickness. The back surface 273 is routed to receive an "L"-shaped support member having the figure "8" configuration as shown in FIG. 5. These channels accommodate an "L"-shaped extrusion of aluminum shown in FIG. 6. The "L"-shaped aluminum extrusion support members are affixed into channels in the back surface 273 with Accrabond™ adhesive. Slats 275, 276, 277 and 278 each having a channel to receive the "L"-shaped support member, are affixed to the back surface 273 with 3M Scotch-Strip™ 4475. The slats 275, 276, 277 and 279 can also be attached with small brads.

In this embodiment a structural honeycomb core of plastic or aluminum is affixed to grooves in the side of the slats 275, 276, 277 and 279. A structural honeycomb is made by sandwiching a core material between skins of aluminum or other high strength composite materials. A bonding adhesive is used to attach the skin material to the honeycomb. An example of suitable honeycomb is PCGA Plascore™ 3003 aluminum alloy commercial grade core. The structural honeycomb can be affixed with any suitable means such as glue or small brads. The structural honeycomb in this embodiment is Plascore™ and is ⅜ inches in thickness. A second sheet of polyvinyl chloride can be affixed to the slats to further strengthen the window shutter. This sheet is between ⅝ to ¾ mm in thickness.

Figure 28:
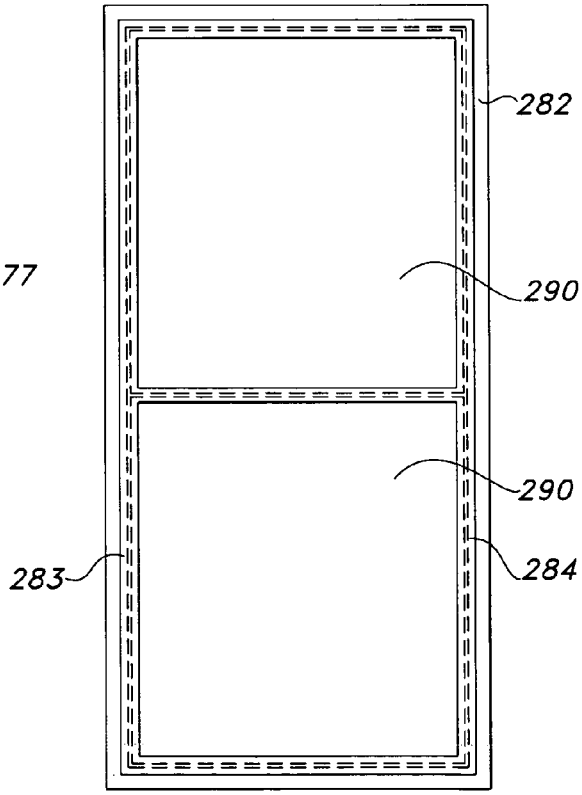
FIG. 28 shows a back view of an alternative embodiment with an impact resistant member.

In the preferred embodiment a sheet of high impact material can be retained by the support members. In this embodiment the solid panel 2 is made from 15 mm sheet of polyvinyl chloride. The front surface 3 can have any type of decorative milling. After the front surface 3 is complete, it is turned over on the CNC machine and a channel is routed in the back surface 282, in a figure "8" configuration 70 to accept the support member. In FIG. 28 the back surface 282 is routed to form a plurality of channels 283 to receive a "T" shaped support member 284. The "T" shaped support member is ⅝ inch in base and 1 and ¾ inches wide at the "T"

portion. The channels 283 are routed in a substantially figure "8" configuration to a depth of about ⅜ inches and width to accept the support members. The "T"-shaped aluminum extrusion support member 284 is affixed into channels 283 in the back surface with a 3M glue (D-419). After the support member 284 is inserted into the channel, a piece of Lexan® 290 is cut and placed in the open sections between the "T" shaped support members. It should be understood that to better utilize materials two smaller pieces of Lexan® can be used instead of one larger piece. The impact resistant member 290 is cut so that is slides under the "T" section of the support member 284. It should be noted that an "L" shaped support member is also suitable to retain the impact resistant member. This impact resistant member 290 is applied to the back surface 282 of the shutter with the edges of the Lexan® adjacent to the outer edges of the channels 283. The Lexan® is applied to the back surface of the panel 282 with glue made by 3M. (D-420). A window shutter having a solid panel of polyvinyl chloride and having at least one support member to retain an impact resistant member is complete and need not have slats attached.

However, slats may be attached as follows: now referring to FIGS. 29 and 30, after the impact resistant member 290 has been put in place, slats 300 and 302 made from three inch wide and 15 mm thick strips of polyvinyl chloride are cut. A plurality of vertical slats 300 and horizontal slats 302 are applied over the support member 284. The slats are attached with a 3M plastic/plastic glue (D 420) and with small brads Referring now to FIG. 31 a plurality of window shutters 320 made in accordance with this disclosure were attached to a dwelling 321 to protect window 325 from extreme weather conditions. The window shutters 320 can be affixed to the dwelling 321 by a variety of means. The window shutter 320 can be notched 11 on the outside edge of the shutter panel 3 to provide a means to affix hinges to secure the window shutter 320 to a dwelling or hinges 322 can be affixed directly to the front or back surfaces of the shutter. The screw affixing the shutter to the dwelling generally has two inches of threaded engagement. The screw can pass through the reinforcing member to provide a more secure attachment.

EXAMPLES

Figure 29:
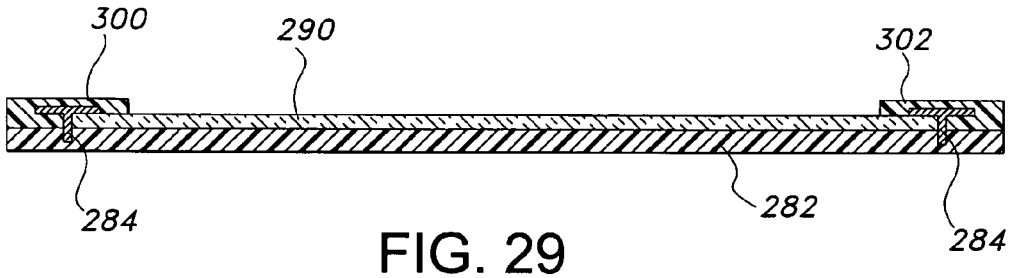
FIG. 29 shows a top view of an alternative embodiment with an impact resistant member.
Figure 30:
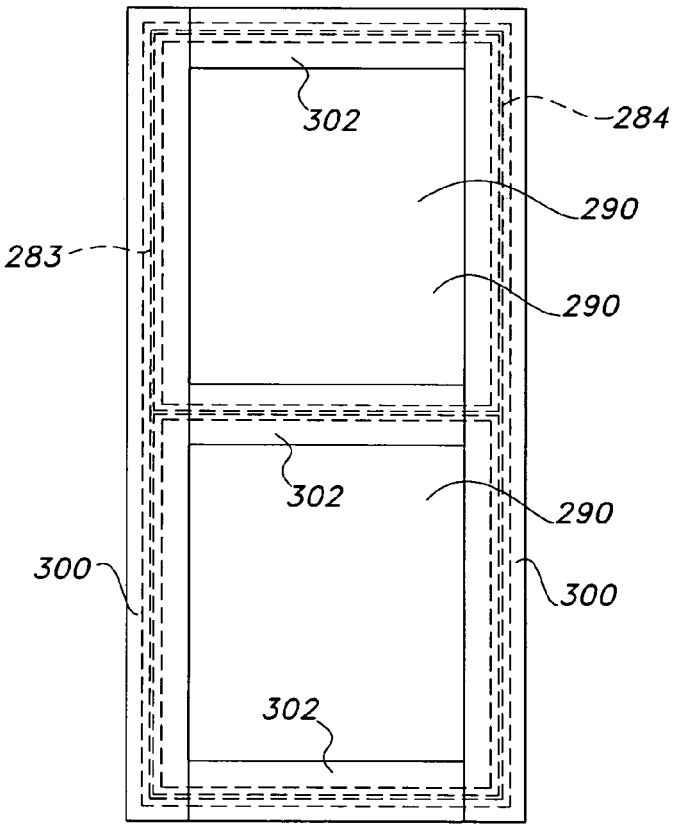
FIG. 30 shows a back view of an alternative embodiment with an impact resistant member.
Figure 31:
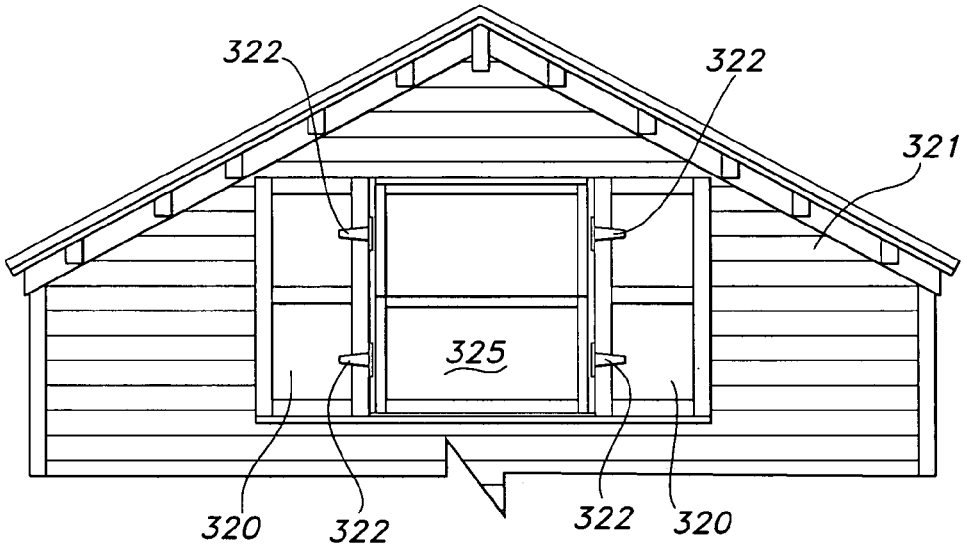
FIG. 31 shows an elevational view of a dwelling with an attached shutter.

A decorative shutter made in accordance with the process disclosed in FIGS. 28–30 was subjected to Impact Test PA 210 by the Hurricane testing Laboratory (hereby incorporated by reference). The function of this test is to detect deflection, penetration or rupture of the shutter when an object, such as a 2 by 4, is fired at high speeds at the shutter. This shutter was the first decorative and functional shutter to pass this rigorous test of strength and structural stability.

While we have illustrated and described several embodiments of the invention, it will be understood that these are by way of illustration and that various changes may be contemplated in this invention within the scope of the following claims.

What is claimed is:

1. A single panel window shutter consisting essentially of:

(a) a single panel of a thermoplastic resin, said single panel having front and back surfaces and side edges, said single panel having a channel to accept at least one support member, wherein said front side of said single panel is configured to define window shutter ornamentation;

(b) at least one support member affixed in said channel; and (c) at least one slat configured to cover said support member, said at least one slat affixed to said single panel.

2. The single panel window shutter of claim 1 wherein at least one substantially lateral support member and at least one substantially longitudinal support member is affixed in said single panel.

3. The single panel window shutter of claim 1 wherein at least two substantially longitudinal support members are affixed in said single panel.

4. The single panel window shutter of claim 1 wherein said single panel window shutter is attached to a dwelling by an attachment means affixed to said support member.

5. A window shutter consisting essentially of:

(a) a single panel of a thermoplastic resin, said panel having front and back surfaces and side edges, said single panel having a channel to accept at least one support member, wherein said front side of said panel is configured to define window shutter ornamentation;

(b) at least one support member affixed in said channel, wherein said support member is configured to retain an impact resistant member; and (c) an impact resistant member retained by said support sheet.

6. The window shutter of claim 5 wherein at least one substantially lateral support member and at least one substantially longitudinal support member is affixed in said single panel.

7. The window shutter of claim 5 wherein at least two substantially longitudinal support members are affixed in said single panel.

8. A window shutter made by the process of:

(a) forming a window shutter from a single panel of a thermoplastic resin, said panel having a front and a back surface and a plurality of side edges, said single panel having a channel to accept at least one support member, wherein said front surface of said single panel is configured to define window shutter ornamentation;

(b) providing at least one support member affixed in said channel; and (c) providing at least one slat configured to cover said support member.

9. A window shutter made by the process of:

(a) forming a window shutter from a single panel of polyvinyl chloride, said panel having a front and a back surface and a plurality of side edges, said single panel having a channel to accept at least one support member, wherein said front side of said single panel is configured to define window shutter ornamentation;

(b) providing at least one support member affixed in said channel, wherein said support member is configured to retain an impact resistant member; and (c) providing an impact resistant member retained by said support sheet.

* * * * *